US010518398B2

(12) United States Patent
Wang et al.

(10) Patent No.: US 10,518,398 B2
(45) **Date of Patent: *Dec. 31, 2019**

(54) MAGAZINE ASSEMBLY AND A STAPLER INCLUDING THE SAME

(71) Applicant: APEX MFG. CO., LTD., Taichung (TW)

(72) Inventors: Jing-Li Wang, Taichung (TW); Py-Yi Chang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 279 days.

This patent is subject to a terminal disclaimer.

(21) Appl. No.: 15/668,311

(22) Filed: Aug. 3, 2017

(65) Prior Publication Data

US 2019/0039222 A1 Feb. 7, 2019

(51) Int. Cl.

| | |
|---|---|
| ***B25C 5/04*** | (2006.01) |
| ***B25C 5/11*** | (2006.01) |
| ***B25C 5/16*** | (2006.01) |
| ***B25C 5/00*** | (2006.01) |

(52) U.S. Cl.
CPC ..... *B25C 5/04* (2013.01); *B25C 5/11* (2013.01); *B25C 5/161* (2013.01); *B25C 5/1686* (2013.01); *B25C 5/00* (2013.01)

(58) Field of Classification Search
CPC ... B25C 5/1651; B25C 5/1658; B25C 5/1644; B25C 5/06; B25C 5/04; B25C 5/00; B25C 5/0285; B25C 5/11; B25C 5/161; B25C 5/1686; B25C 5/1696
USPC ..... 227/109, 120
See application file for complete search history.

(56) References Cited

U.S. PATENT DOCUMENTS

| | | | | |
|---|---|---|---|---|
| 3,633,811 | A * | 1/1972 | Ploen | B25C 1/005 227/109 |
| 6,974,067 | B2 * | 12/2005 | Chen | B25C 1/005 227/109 |
| 7,549,562 | B2 * | 6/2009 | Wu | B25C 1/005 227/109 |
| 2006/0108390 | A1 * | 5/2006 | Schnell | B25C 1/005 227/120 |
| 2008/0067089 | A1 * | 3/2008 | Zhu | B25C 5/1651 206/340 |
| 2013/0221056 | A1 * | 8/2013 | Chen | B25C 5/162 227/120 |

(Continued)

*Primary Examiner* — Hemant Desai
*Assistant Examiner* — Veronica Martin
(74) *Attorney, Agent, or Firm* — Muncy, Geissler, Olds & Lowe, P.C.

(57) ABSTRACT

A magazine assembly and a stapler including the same are provided. The magazine assembly includes a base and a rail assembly. The base has a first end portion and a second end portion. A direction from the second end portion toward the first end portion is defined as a first direction. The rail assembly is disposed on the base and adapted for a staple unit to slidably abut thereagainst along the first direction. The rail assembly includes a first rail and a second rail which are separate. A first side wall of the first rail has at least one guide portion extending in the first direction. Each guide portion is adapted for a head of a T-shaped staple to slidably engage therewithalong the first direction. The second rail is adapted for a U-shaped staple to abut thereagainst.

10 Claims, 11 Drawing Sheets

(56) References Cited

U.S. PATENT DOCUMENTS

2015/0352703 A1* 12/2015 Wu ..... B25C 5/06
227/109

* cited by examiner

MAGAZINE ASSEMBLY AND A STAPLER INCLUDING THE SAME

BACKGROUND OF THE INVENTION

Field of the Invention

The present invention relates to a magazine assembly and a stapler including the same.

Description of the Prior Art

A stapler is an essential tool for workers in interior decoration construction and wood industry. The stapler can connect different workpieces (such as woods) together. Understandably, there are many processes such as cutting, transport, etc. in a construction process so that it is easy to deplete a lot of efforts of the workers. Therefore, most of inventors of the conventional stapler focus on the effort-saving mechanism to hope for discharging the stapler by fewer efforts to save the efforts of the workers and increase a packaging efficiency.

However, inventors of the conventional stapler ignore that other structures such as configuration structures between a magazine assembly and staples also do effect a stability of discharging of stapler, and a quality of assembled products.

The present invention is, therefore, arisen to obviate or at least mitigate the above mentioned disadvantages.

SUMMARY OF THE INVENTION

The main object of the present invention is to provide a magazine assembly and a staple including the same which the design of a top of a first and second rails are located at the same horizon to applied for different staples (such as a T-shaped staple, a U-shaped staple, a reverse U-shaped staple, or a roof-shaped staple); and a cover has a substantially flat structure.

To achieve the above and other objects, the magazine assembly is configured to be assembled to a stapler, includes a base, a rail assembly, and a cover member. The base has a first end portion and a second end portion. A direction from the second end portion toward the first end portion is defined as a first direction. The rail assembly is disposed on the base and adapted for a staple unit to movably abut thereagainst along the first direction. The rail assembly includes a first rail and a second rail which are separate. The staple unit includes a T-shaped staple, a U-shaped staple, a reverse U-shaped staple, and roof-shaped staple. Wherein a distance between a top of the first rail and the base is substantially equal to a distance between a top of the second rail and the base. Wherein the U-shaped staple defines two straight sections and a curve section, as viewed in the first direction, the U-shaped staple is divided equally by the center line, the second rail has two guiding portions, the two guiding portions are adapted for abutting against an inner wall of the curve section, and being located by two sides of the center line, each of the guiding portions has a first end point, a second end point and a successive segment, the first end point is closer to the center line than the second end point, and the first end point is farther away the base than the second end point, and the successive segment is connected with the first end point and the second end point. The cover member covers the base. The cover member has a top plate and two side plates which are connected with the top plate. The rail assembly is disposed between the top plate and the base. The top plate includes a raised section and two limit sections located by two sides of the raised section. The raised section is raised in the direction which is far away the rail assembly.

To achieve the above and other objects, further includes the stapler. The stapler includes a machine assembly. The machine assembly includes a pressing member, a shell and an impact plate. The shell has a magazine portion receiving the magazine assembly. The magazine assembly and the shell define a discharge opening therebetween. The discharge opening is adapted for corresponding to part of the staple unit, the pressing member and the impact plate is comovable. Wherein when the pressing member is moved relative to the shell, the pressing member drives the impact plate to move toward the discharge opening to discharge the part of the staple unit.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
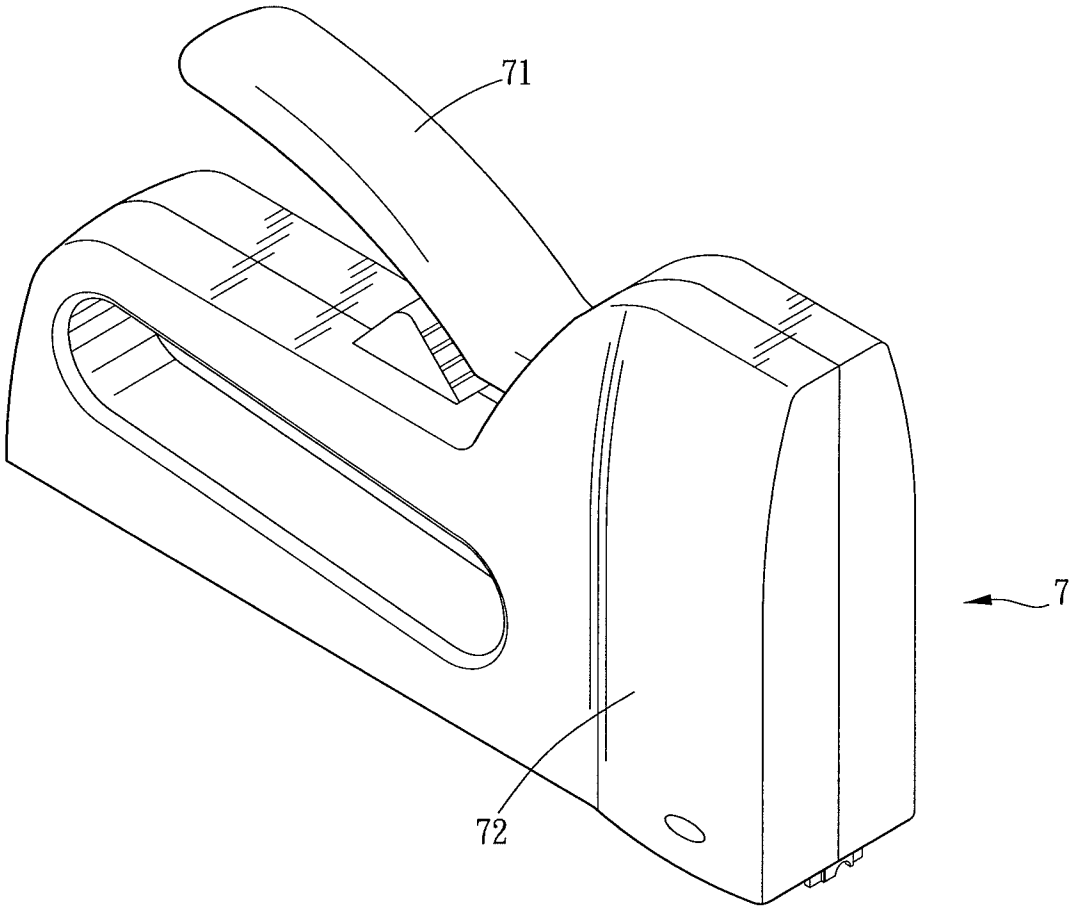
FIG. 1 is a stereogram of a preferred embodiment the present invention.
Figure 2:
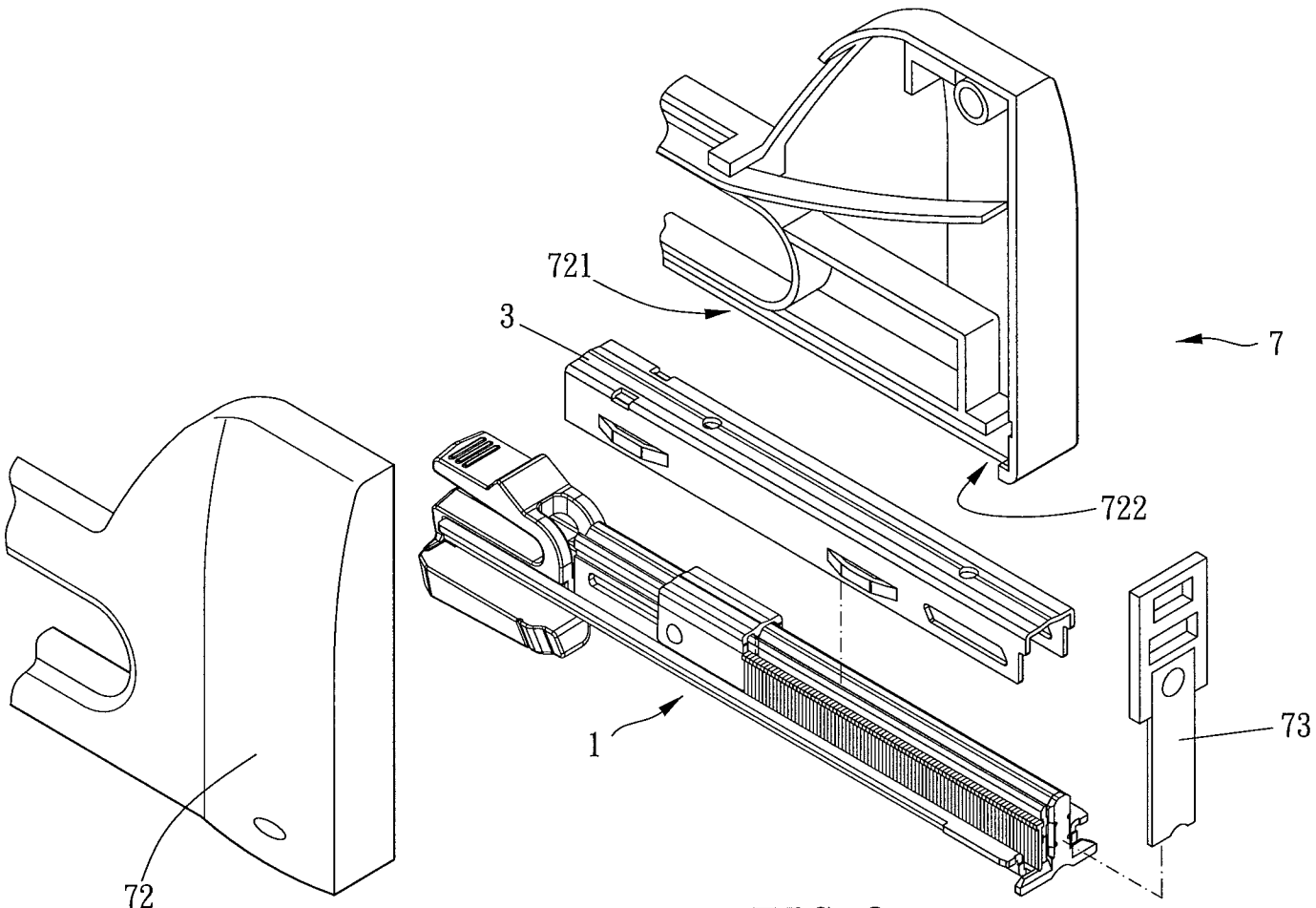
FIG. 2 is a breakdown view of the FIG. 1.
Figure 3:
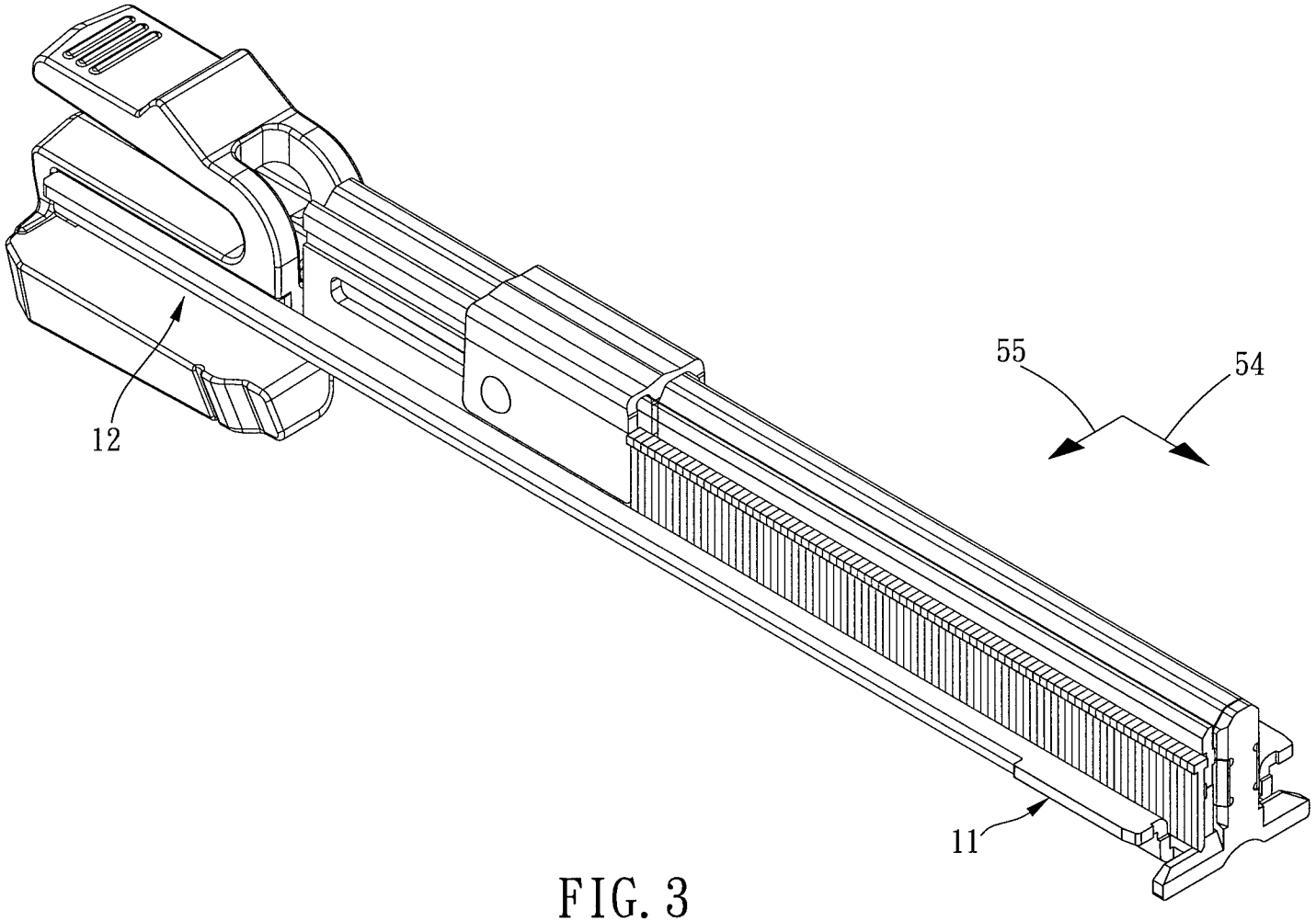
FIG. 3 is a stereogram of a magazine assembly.
Figure 4:
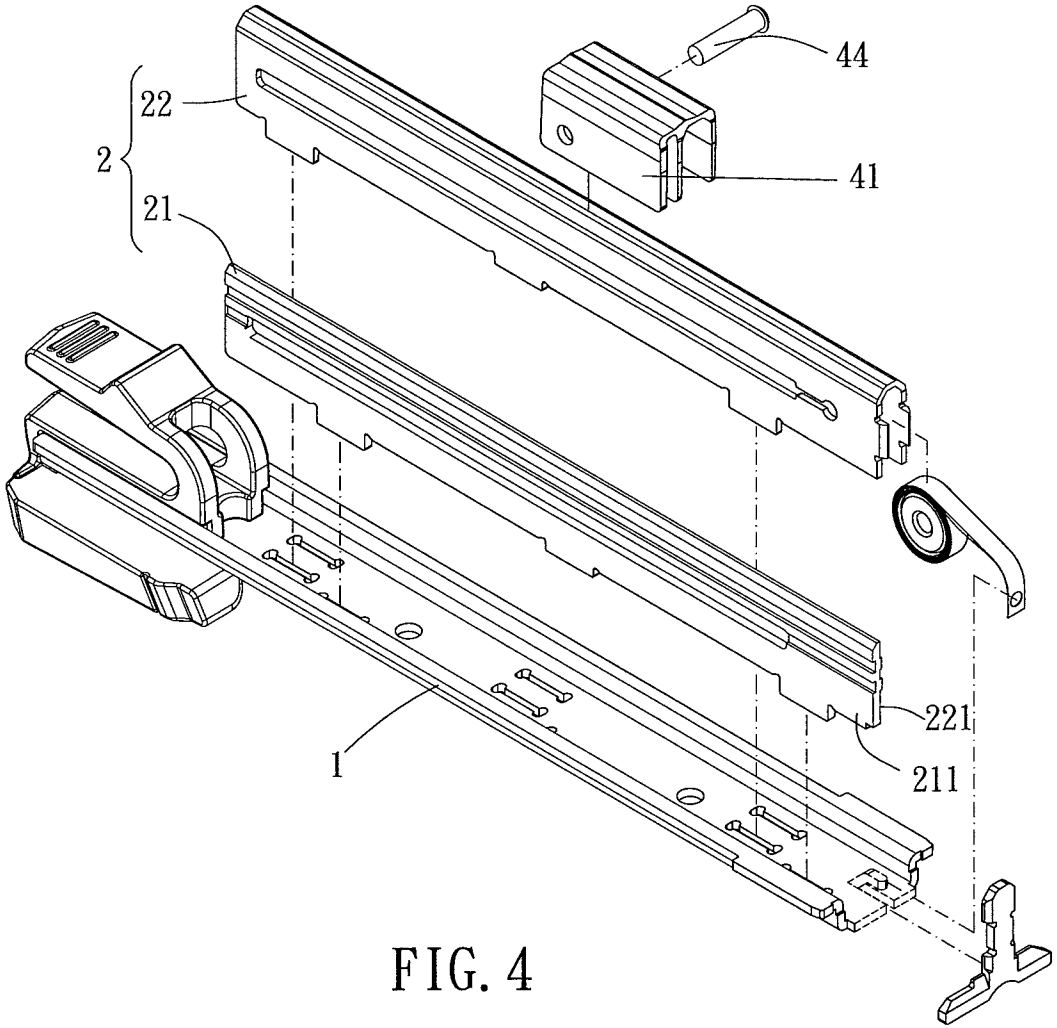
FIG. 4 is a breakdown view of the FIG. 3.
Figure 5:
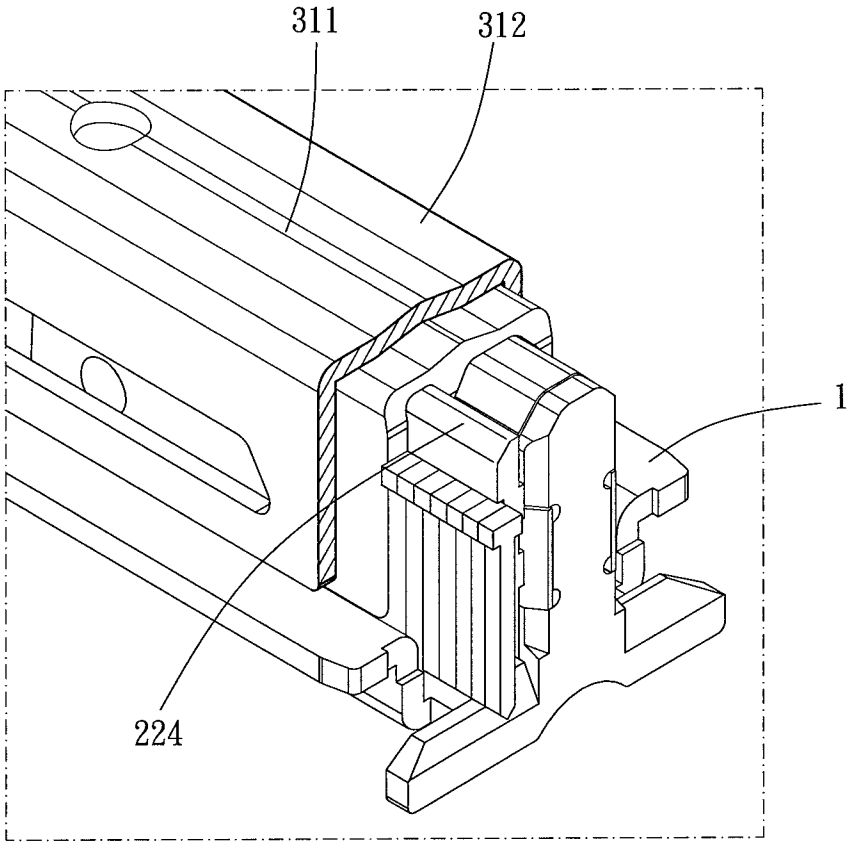
FIG. 5 to FIG. 6 are partially-stereogram views of the preferred embodiment of the present invention.
Figure 6:
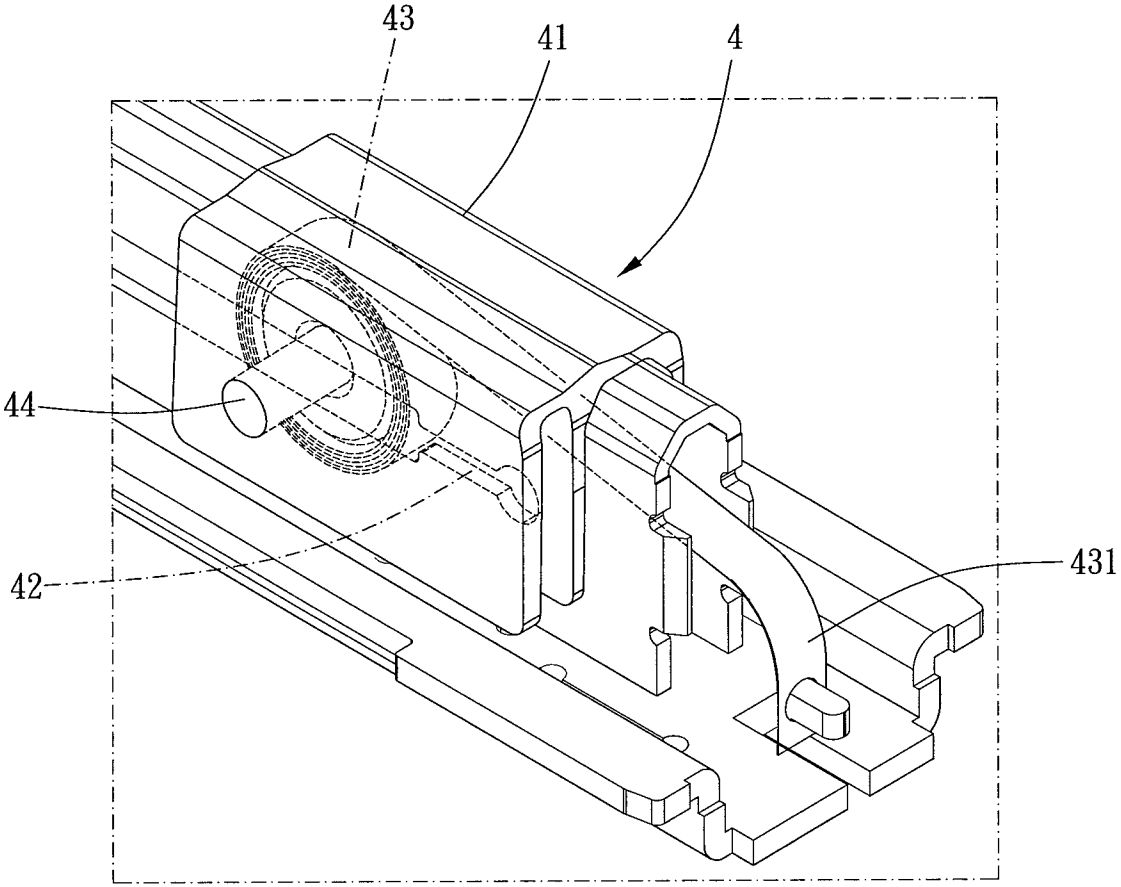
Figure 7:
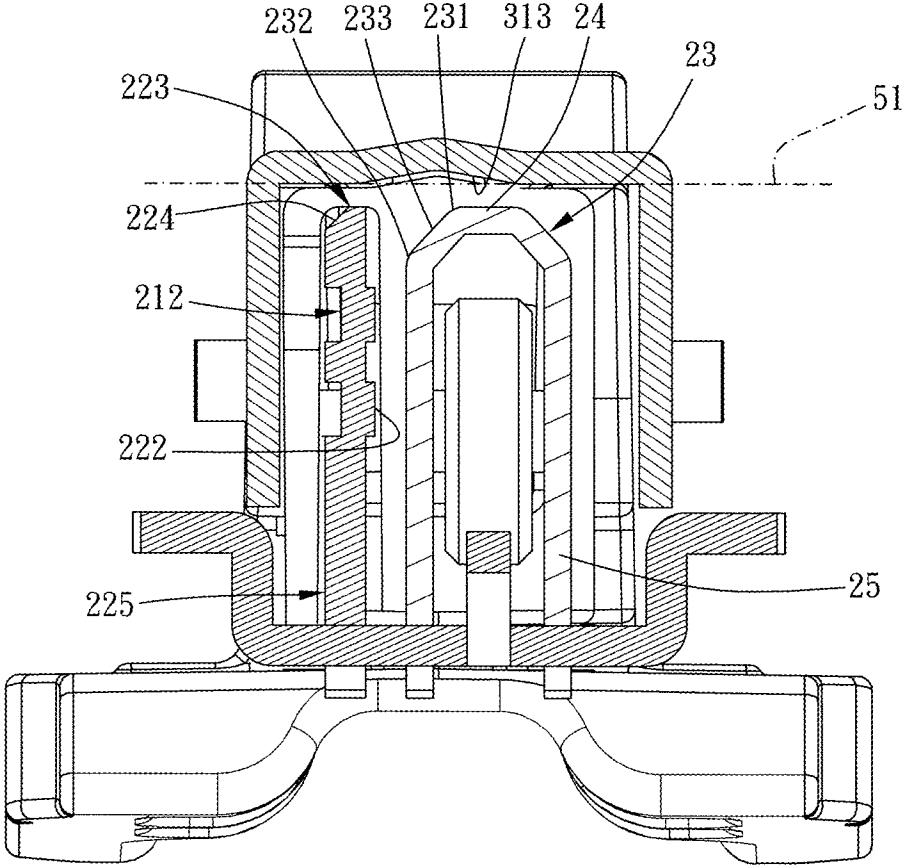
FIG. 7 is a cross-sectional view of the magazine assembly.
Figure 8:
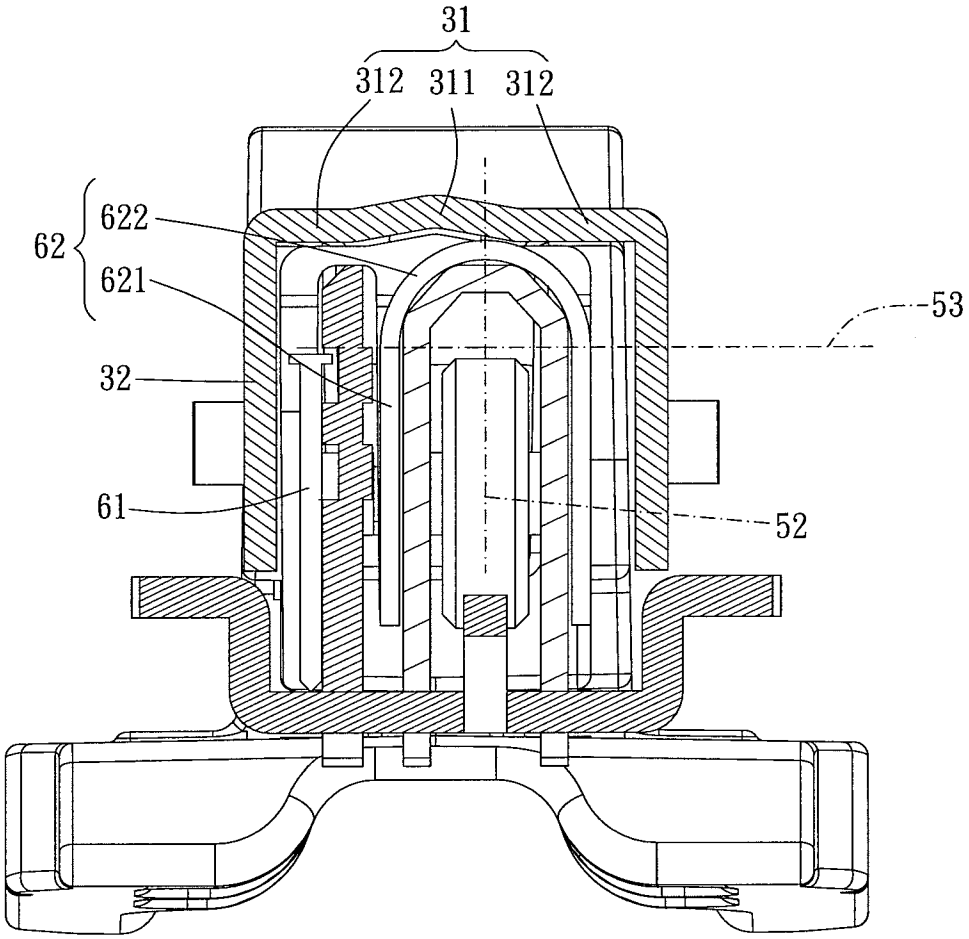
FIG. 8 to FIG. 11 are cross-sectional views of different staples being disposed in the staple assembly.
Figure 10:
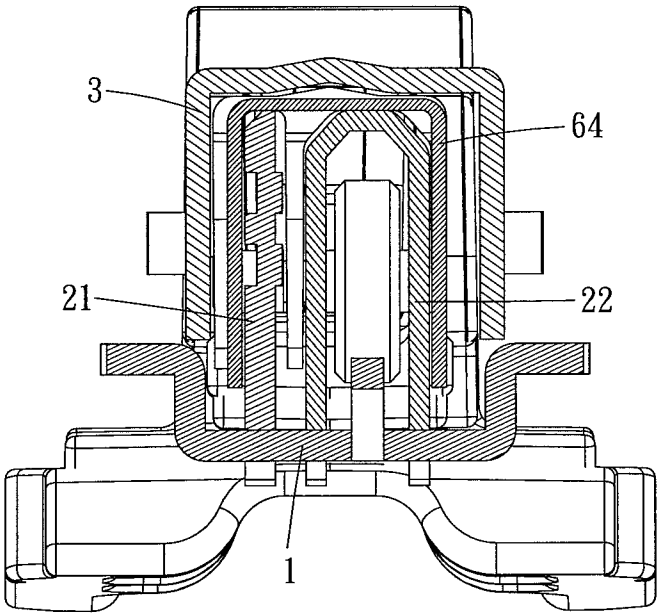
Figure 9:
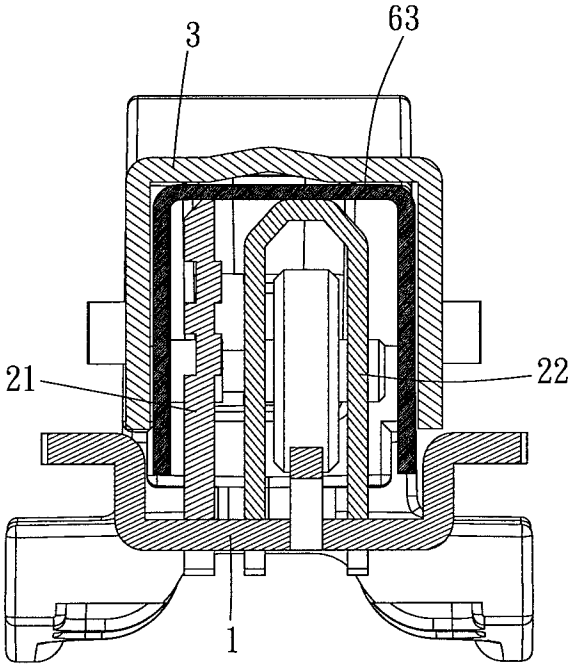

Please refer to FIG. 1 to FIG. 11 show the magazine assembly and the stapler including the same according to a preferred embodiment of the present invention.

The stapler not only includes the magazine assembly, but also further includes a machine assembly 7. The machine assembly 7 includes a pressing member 71, a shell 72 and an impact plate 73. The shell 72 has a magazine portion 721 receiving the magazine assembly. The magazine assembly and the shell 72 define a discharge opening 722 therebetween. The discharge opening 722 is adapted for corresponding to part of the staple unit. The pressing member 71 and the impact plate 73 are comovable, wherein when the pressing member 71 is moved relative to the shell 72, the pressing member 71 drives the impact plate 73 to move toward the discharge opening 722 to discharge the part of the staple unit. Specifically, the stapler is for instance a manual operation in this embodiment. The stapler is driven by an elastic plate which is connected with the pressing member 71 and the impact plate 73 through a connection mechanism, and being discharged by a rebound force formed by bending the elastic plate 73. However, the present invention is not limited to this type, in other embodiments the stapler also can be a pneumatic stapler or an electric stapler.

Continuously, the following is the description of the magazine assembly. The magazine assembly is configured to be assembled to a stapler. The magazine assembly includes a base 1, a rail assembly 2 and a cover 3.

The base 1 has a first end portion 11 and a second end portion 12, a direction from the second end portion 12 toward the first end portion 11 being defined as a first direction 54. The rail assembly 2 is disposed on the base 1 and adapted for a staple unit to movably abut thereagainst along the first direction 54. The rail assembly 2 includes a first rail 21 and a second rail 22 which are separate, and the staple unit includes a T-shaped staple 61, a U-shaped staple 62, a reverse U-shaped staple, and a roof-shaped staple 65 (the roof-shaped staple 65 for example means that part of the staple is roof-shaped). Understandably, the rail assembly 2 is disposed on the base 1 in this embodiment; in other embodiments, the rail assembly and the base are made integrally.

Preferably, the first rail 21 is adapted for being abutted against by the T-shaped staple 61 of the staple unit independently, the second rail 22 is adapted for being abutted against by the U-shaped staple 62 of the staple unit, and the first and the second rails 21, 22 are adapted for being abutted against by the reverse U-shaped staple or the roof-shaped staple 65 simultaneously. Moreover, a distance between a top of the first rail 21 and the base 1 is substantially equal to a distance between a top of the second rail 22 and the base 1 so that the first and second rails 21, 22 have the co-supporting face to support a reverse U-shaped staple and the roof-shaped staple 65.

Specifically, the U-shaped staple 62 defines two straight sections 621 and a curve section 622, as viewed in the first direction 54, the U-shaped staple 62 is divided equally by a center line 52. The second rail 22 has two guiding portions 23, the two guiding portions 23 are adapted for abutting against an inner wall of the curve section 622 and being located by two sides of the center line 52. Each of the guiding portions 23 has a first end point 231, a second end point 232 and a successive segment 233, the first end point 521 is closer to the center line 92 than the second end point 522, and the first end point 231 is farther away the base 1 than the second end point 232, the successive segment 233 is connected with the first end point 231 and the second end point 232.

It is to be noted that the first and the second end points 231, 232 are adapted for abutting against an inner wall of the curve section 622, and the successive segment 233 does not contact the inner wall of the curve section 622 so as to reduce the contact area and further reduce the friction therebetween. In other words, the second rail 22 is connected with the U-shaped staple 62 by connection points so that the U-shaped staple 62 is slidable relative to the second rail 22 smoothly, thus the height of the U-shaped staple 62 can be controlled precisely (a distance between the highest point of the U-shaped staple 62 and the base 1). For example, a height position of the U-shapes staple 62 may equal to a height position of the T-shaped 61 which is disposed on the first rail 21 so as to keep the staples in the same highest level when the staple unit is assembled to the rail assembly 2 so as to configure to assemble other structures such as the cover 3.

Figure 11:
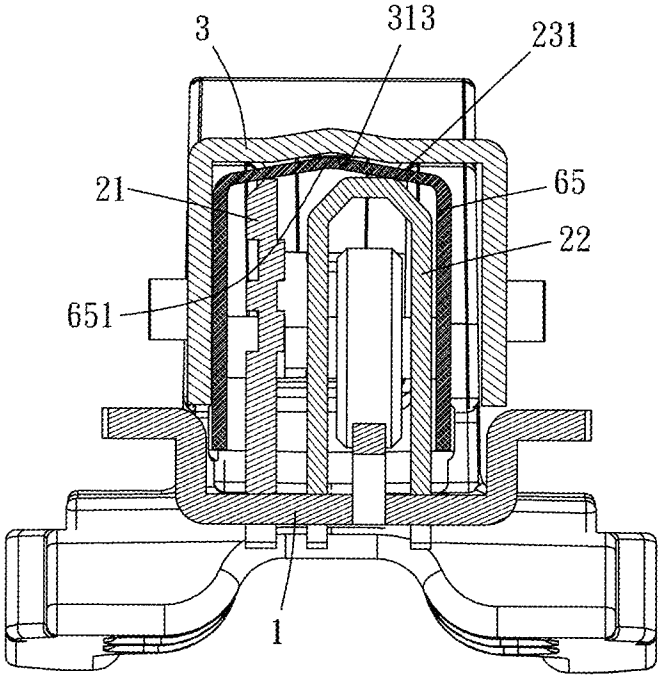

The cover member 3 covers the base 1. Wherein, the cover member 3 can be position inside the shell 72 so as to cover the base 1 exactly. The cover member 3 has a top plate 31 and two side plates 32 which are connected with the top plate 31. The rail assembly 2 is disposed between the top plate 31 and the base 1. The top plate 31 includes a raised section 311 and two limit sections 312 located by two sides of the raised section 311. Because of the T-shaped staple 61 and the U-shaped staple 62 which are disposed in the rail assembly 2 has the same highest height, thus a design of the two limit sections 312 can be located in a same plane 51. Therefore, the whole of the cover member 3 does not have significant different heights in the direction of the center line 52 so as to have a simple manufacture process. Wherein, the raised section 311 is raised in the direction which is far away the rail assembly 2, the raised section 311 is adapted for a protruded portion 651 of the roof-shaped staple 65 passing through (as shown in FIG. 11), and the roof-shaped staple 65 is symmetrically supported by the first end point 231 of the top of the first rail 21. The cover member 3 is integrally formed of one piece and positioned inside the shell 72, and the cover member 3 is narrower and shorter than the base 1. The raised section 311 and the two limit sections 312 laterally extend on a same plane. The raised section 311 defines a concave 313 which is concaved from the two limit sections 312 in the direction which is away from the rail assembly 2. The protruded portion 651 of the roof-shaped staple 65 is raised and concaved in the direction which is away from the rail assembly 2, the protruded portion 651 projects into the concave 313 when the roof-shaped staple 65 is supported on the rail assembly 2, and as viewed in a direction in which the two side plates 32 face each other, the protruded portion 651 is partially overlapped with the two limit sections 312.

Continuously, the following is a description of the second rail 22. Preferably, the second rail 22 further has a connection portion 24 connected with the two guiding portions 23, the connection portion 24 can further improve a stability and strength of the two guiding portions 23 so as to prolong a lifespan. Moreover, the connection portion 24 is between a phantom line and the base 1, and the phantom line is between the first end points 231 of the two guiding portions 23 so as to ensure not to effect the highest position of the U-shaped staple 62. That is, the connection portion 24 does not contact the curve section 622.

In this embodiment, the connection portion 24 is connected with the two guiding portions 23 along a direction in which the phantom line extends so that when the reverse U-shaped staple is disposed in the staple assembly, the connection portion 24 can provide more contact areas to increase the stability. Wherein, the reverse U-shaped includes a big reverse U-shaped staple 63 and a small reverse U-shaped staple 64. When the big reverse U-shaped staple 63 is disposed in the staple assembly, the big reverse U-shaped staple 63 is abutted against laterally by the two limit sections 312 and two side plates 32 so as to keep the big reverse U-shaped staple 63 assembled stably. And when the small reverse U-shaped staple 64 is disposed in the staple assembly, the small reverse U-shaped staple 64 is clamped by the first rail 21 and the second rail 22 so as to prevent the small reverse U-shaped staple 64 from swaying.

As viewed in the first direction 54, the two guiding portions 23 are symmetrically arranged and slant relative to the center line 52. The guiding portions 23 and the connection portion 24 are configured to be a part of a trapezoid. The successive segment 233 is an inclined face. Of course, the present invention is not to be limited by the above description.

For example, as shown in 12 is the other preferred embodiment, as viewed in the first direction 54. The successive segment 233A of one of the two guiding portions 23A is an inclined face and approximates to the first rail 21A, and the successive segment 233B of the other of two guiding portions 23B is stepped and away from the first rail 21A. Wherein, the stepped guiding portions 233B are adapted for the head of the T-shaped staple 81 abutting thereagainst. That is, the T-shaped staple 81 can abut against in two positions (the first rail 21A and the successive segment 233B). Besides, in other embodiments, the successive segment 523 can be arc convex shaped, arc concave shaped, wave-shaped, saw tooth-shaped, or other geometric shaped etc.

Please refer to FIG. 1 to FIG. 11 again of this embodiment, the U-shaped staple 62 defines a datum line 53 passing through two joins of the two straight sections 621 and the curve section 622, and the two guiding portions 23 and the connection portion 24 locate between the datum line 53 and the curve section 622. Wherein, a length of the connection portion 24 is equal to a length of each of the guiding portions 23.

Specifically, the second rail 22 further includes two stand portions 25 which are separate, each of the two stand portions 25 is respectively connected with each guiding portion 23 and the base 1, and each join of one of the two stand portions 25 and one of the two guiding portions 23 is a rounded corner and defined as the second end point 232, each join of the guiding portions 23 and the connection portion 24 is a rounded corner and defined as the first end point 231. Wherein the first and second end points 231, 232 which are as the round corners are matching to the curve section 622 so that the U-shaped staple 62 can be moved slidably easily, and also can reduce a chance of the guiding portions 23 and the curve section 622 be broken by the friction.

Figure 12:
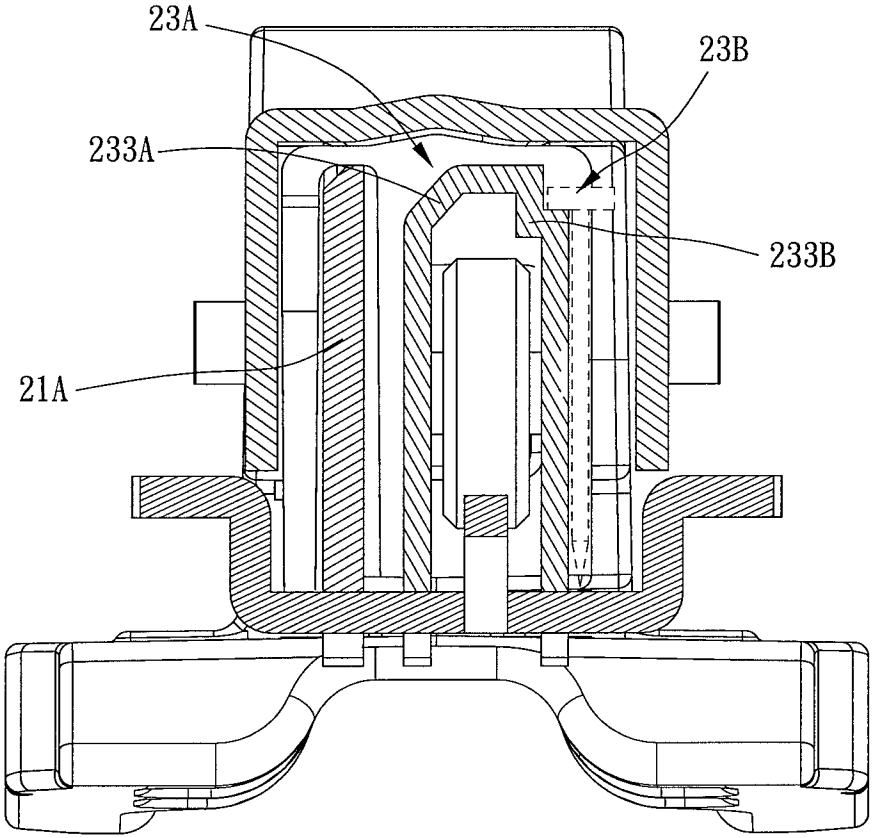
FIG. 12 is a cross-sectional view of the other embodiment of the present invention.

The first rail 21 has at least one groove portion 212 extending along the first direction 54 is disposed on a first side wall 211 facing in a direction away from the second rail 22. And the at least one groove portion 212 is adapted for a head of the T-shaped staple 61 to slidably engage therewith along the first direction 54, and assembling a variety of T-shaped staples 61 with different lengths (the features can also apply to the other embodiment as shown in FIG. 12). The first rail 21 further has a second side wall 221 facing the second rail 22, the second side wall 221 has at least one rib portion 222 extending along the first direction 54, the at least one rib portion 222 corresponds to the at least one groove portion 212 so as to enhance the strength of the first rail 21, and the at least one rib portion 222 protrudes toward the second rail 22 for being abutted against laterally by the U-shaped staple 62 so as to improve the stability of the U-shaped staple 62.

Besides, the first rail 21 further includes a top portion 223 and a bottom portion 225 which are connected with the first side wall 211 and the second side wall 221. The bottom portion 225 is connected with the base 1. The top portion 223 has an inclined face 224, the inclined face 224 extends slantly from the second side wall 221 toward the first side wall 211 and the base 1, and the inclined face 224 is for being abutted against by the head of the T-shaped staple 61. Thus, the inclined face 224 which has contact portions of different heights relative to the base 1 can abut T-shaped staples 61 of different lengths. Therefore, the T-shaped staple 61 can abut against exactly the base 1.

In addition, the magazine assembly further includes a pushing mechanism 4, the pushing mechanism 4 has a pushing member 41, at least one slide track 42, and a constant torque spring 43 which rolls back normally. Specifically, the pushing member 41 is adapted for being movably disposed on the base 1 for movement of the pushing member 41 along the first direction 54, the pushing member 41 is adapted for being abutted by the staple unit so that the pushing member 41 and the staple unit are comovable. The at least one slide track 42 is adapted for being disposed on the base 1 or the rail assembly 2 along the first direction 54. The constant torque spring 43 is rollably attached to the pushing member 41; wherein a free end 431 of the constant torque spring 43 is positioned at the first end portion 11 so as to normally bias the pushing member 41 to move toward the first end portion 11. Thus, the constant torque spring 43 can prevent the staple unit from swaying and to be kept in a stable state until the staple is discharged so as to have a higher quality of discharge and a prescise location of staple unit after discharging.

Specifically, the pushing member 41 is disposed on the rail assembly 2. A number of the at least one slide 42 is three, and the three slides 42 penetrate the first and the second rails 21, 22 respectively. The constant torque spring 43 is disposed inside the second rail 22 so that when there is an unexpected impact, the constant torque spring 43 does not be separated by an impact force. In this embodiment, an axle 44 is connected with the pushing member 41, and disposed through the constant torque spring 43 and each of the three slides 42 along a second direction 55. The constant torque spring 43 rotates about the axle 44. The axle 44 is slidably disposed within each of the three slides 42, and the second direction 55 is perpendicular to the first direction 54.

Given the above, the magazine assembly and the stapler including the same of the present invention, the magazine assembly has the first and second rails, and the height of the first rail and the height of the second rail are in the same horizon. It is convenient to use due to be adapted for assembling different types of staples (such as the T-shaped, U-shaped and reverse U-shaped staples). Furthermore, the design of the guiding portions can keep the height of the U-shaped staple which is disposed on the second rail and the height of the T-shaped staple which is disposed on the first rail are in the same height. Thus, the cover can cover the rail assembly flatly.

While we have shown and described various embodiments in accordance with the present invention, it should be clear to those skilled in the art that further embodiments may be made without departing from the scope of the present invention.

What is claimed is:

1. A magazine assembly, configured to be assembled inside a shell of a stapler, including:

a base, having a first end portion and a second end portion, a direction from the second end portion toward the first end portion being defined as a first direction;

a rail assembly, disposed on the base and adapted for a staple unit to movably abut thereagainst along the first direction, including a first rail and a second rail which are separate, the staple unit including at least one of a T-shaped staple, a U-shaped staple, a second U-shaped staple, and a roof-shaped staple, the rail assembly being configured to support one of the T-shaped staple, the U-shaped staple, the second U-shaped staple and the roof-shaped staple at one time;

wherein a distance between a top of the first rail and the base is substantially equal to a distance between a top of the second rail and the base;

wherein the U-shaped staple defines two straight sections and a curve section, as viewed in the first direction, the U-shaped staple is divided equally by a center line, the second rail has two guiding portions, the two guiding portions are adapted for abutting against an inner wall of the curve section, and being located by two sides of the center line, each of the guiding portions has a first end point, a second end point and a successive segment, the first end point is closer to the center line than the second end point, and the first end point is farther away the base than the second end point, and the successive segment is connected with the first end point and the second end point; and a cover member, covering the base, having a top plate and two side plates which are connected with the top plate, the rail assembly is disposed between the top plate and the base, the top plate includes a raised section and two limit sections located by two sides of the raised section, and the raised section is raised in a direction which is away from the rail assembly, the raised section defines a concave which is concaved from the two limit sections in the direction which is away from the rail assembly;

wherein the cover member is integrally formed of one piece and positioned inside the shell, and the cover member is narrower and shorter than the base;

wherein a protruded portion of the roof-shaped staple is raised and concaved in the direction which is away from the rail assembly, the protruded portion projects into the concave when the roof-shaped staple is supported on the rail assembly, and as viewed in a direction in which the two side plates face each other, the protruded portion is partially overlapped with the two limit sections.

2. The magazine assembly of claim 1, further includes a pushing mechanism, the pushing mechanism has a pushing member, at least one slide track, and a constant torque spring, the pushing member is adapted for being movably disposed on the base for movement of the pushing member along the first direction, the pushing member is adapted for being abutted by the staple unit so that the pushing member and the staple unit are comovable, the at least one slide track is adapted for being disposed on the base or the rail assembly along the first direction, the constant torque spring is rollably attached to the pushing member; a free end of the constant torque spring is positioned at the first end portion so as to normally bias the pushing member to move toward the first end portion.

3. The magazine assembly of claim 2, wherein the pushing member is disposed on the rail assembly, the pushing member includes two said slide tracks, one of two said slide tracks penetrates the first rail and the other of two said slide tracks penetrates the second rails, the constant torque spring is disposed inside the second rail, an axle is connected with the pushing member and disposed through the constant torque spring and each of two said slide tracks along a second direction, the constant torque spring rotates about the axle, the axle is slidably disposed within each of two said side tracks, and the second direction is perpendicular to the first direction.

4. The magazine assembly of claim 1, wherein the first and the second end points are adapted for abutting against an inner wall of the curve section, and the successive segment does not contact the inner wall of the curve section.

5. The magazine assembly of claim 1, wherein the first rail has at least one groove portion extending along the first direction is disposed on a first side wall facing in a direction away from the second rail, and the at least one groove portion is adapted for a head of the T-shaped staple to slidably engage therewith along the first direction.

6. The magazine assembly of claim 5, wherein the first rail further has a second side wall facing the second rail, the second side wall has at least one rib portion extending along the first direction, the at least one rib portion corresponds to the at least one groove portion, and the at least one rib portion protrudes toward the second rail for being abutted against laterally by the U-shaped staple.

7. The magazine assembly of claim 6, wherein the first rail further includes a top portion and a bottom portion which are connected with the first side wall and the second side wall, the bottom portion is connected with the base, the top portion has an inclined face, and the inclined face extends slantly from the second side wall toward the first side wall and the base, and the inclined face is for being abutted against by the head of the T-shaped staple.

8. The magazine assembly of claim 7, further including a pushing mechanism, wherein the pushing mechanism has a pushing member, at least one slide track, and a constant torque spring, the pushing member is adapted for being movably disposed on the base for movement of the pushing member along the first direction, the pushing member is adapted for being abutted by the staple unit so that the pushing member and the staple unit are comovable, the at least one slide track is adapted for being disposed on the base or the rail assembly along the first direction, the constant torque spring is rollably attached to the pushing member, a free end of the constant torque spring is positioned at the first end portion so as to normally bias the pushing member to move toward the first end portion; the first rail is adapted for being abutted against by the T-shaped staple of the staple unit independently, the second rail is adapted for being abutted against by the U-shaped staple of the staple unit, the first and the second rails are adapted for being abutted by the second U-shaped staple or the roof-shaped staple simultaneously; the pushing member is disposed on the rail assembly, the pushing member includes two said slide tracks, one of two said slide tracks penetrates the first rail and the other of two said slide tracks penetrates the second rail, the constant torque spring is disposed inside the second rail, an axle is connected with the pushing member and disposed through the constant torque spring and each of two said slide tracks along a second direction, the constant torque spring rotates about the axle as an axis, the axis is slidably disposed within each of two said slide tracks, and the second direction is perpendicular to the first direction; the first and the second end points are adapted for abutting against an inner wall of the curve section, and the successive segment does not contact the inner wall of the curve section; the second rail further has a connection portion connected with the two guiding portions, the connection portion is between a phantom line and the base, and the phantom line is between the first end points of the two guiding portions; as viewed in the first direction, the two guiding portions are symmetrically arranged and slant relative to the center line, and the successive segment is an inclined face, the U-shaped staple defines a datum line passing through two joins of the two straight sections and the curve section, and the two guiding portions and the connection portion are located between the datum line and the curve section; the connection portion is connected with the two guiding portions along a direction in which the phantom line extends, the connection portion and the two guiding portions are configured to be a part of a trapezoid; the second rail further includes two stand portions which are separate, each of the two stand portions is respectively connected with each guiding portion and the base; and each join of one of the two stand portions and one of the two guiding portions is a rounded corner and defined as the second end point, each join of the guiding portions and the connection portion is a rounded corner and defined as the first end point.

9. The magazine assembly of claim 1, wherein as viewed in the first direction, the successive segment of one of the two guiding portions is an inclined face and approximates to the first rail, and the successive segment of the other of the two guiding portions is stepped and away from the first rail.

10. A stapler including the magazine assembly of claim 1, further including:

a machine assembly, including a pressing member, the shell and an impact plate, the shell having a magazine portion receiving the magazine assembly, the magazine assembly and the shell defining a discharge opening therebetween, the discharge opening being adapted for corresponding to part of the staple unit, the pressing member and the impact plate being comovable, wherein when the pressing member is moved relative to the shell, the pressing member drives the impact plate to move toward the discharge opening to discharge the part of the staple unit.

* * * * *